United States Patent [19]

Travis

[11] Patent Number: 4,872,598

[45] Date of Patent: Oct. 10, 1989

[54] DUSTING APPARATUS

[76] Inventor: Tonny D. Travis, 113½ Laurel Ter., Beckley, W. Va. 25801

[21] Appl. No.: 192,769

[22] Filed: May 10, 1988

[51] Int. Cl.[4] ..... B05B 7/00

[52] U.S. Cl. ..... 222/630; 406/118; 406/146; 406/174

[58] Field of Search ..... 222/630; 406/118, 137, 406/146, 153, 174, 141, 142, 143; 137/268

[56] References Cited

U.S. PATENT DOCUMENTS

| | | | |
|---|---|---|---|
| 2,675,275 | 4/1954 | Burtis et al. | 406/118 |
| 2,792,971 | 5/1957 | Kaiser | 222/630 |
| 2,813,755 | 11/1957 | Payne et al. | 406/141 X |
| 3,179,378 | 4/1965 | Zenz et al. | 406/146 X |

FOREIGN PATENT DOCUMENTS

| | | | |
|---|---|---|---|
| 1132867 | 7/1962 | Fed. Rep. of Germany | 137/268 |
| 180992 | 5/1966 | U.S.S.R. | 406/142 |
| 1224227 | 4/1986 | U.S.S.R. | 406/142 |
| 869963 | 6/1961 | United Kingdom | 222/630 |

*Primary Examiner*—H. Grant Skaggs

[57] ABSTRACT

An apparatus for dispersing duct material into the atmosphere at low concentration levels and substantially uniform rates, wherein the apparatus has a tank, a fluidizer positioned in a lower portion of the tank, an air feed communicating with the fluidizer, a discharge port in an upper portion of the tank, a tubular densifier mounted substantially vertically in the tank and extending from a lower portion thereof to adjacent the port, the densifier having an air inlet adjacent its lower end and an outlet adjacent its upper end in direct and immediate communication with the port, and, an air feed communicating with the inlet, the densifier having longitudinally spaced passages therein for the transfer of dust material from the tank into the densifier for transportation to the discharge port.

13 Claims, 2 Drawing Sheets

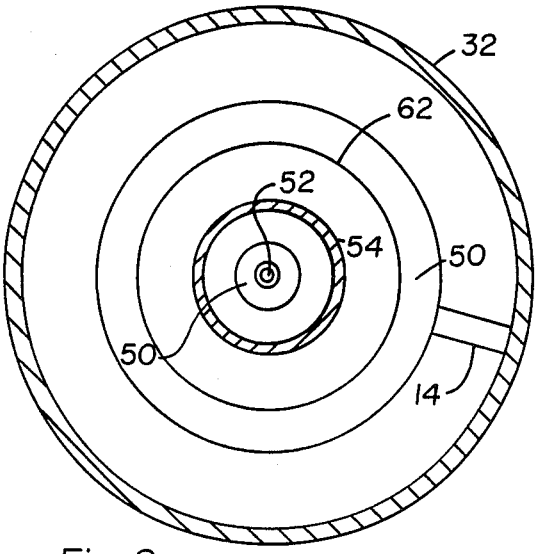
Fig. 2
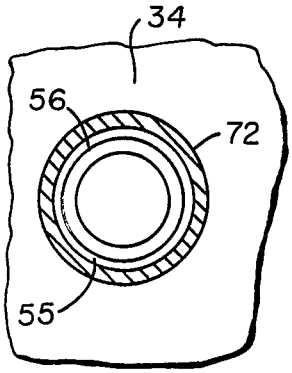
Fig. 4
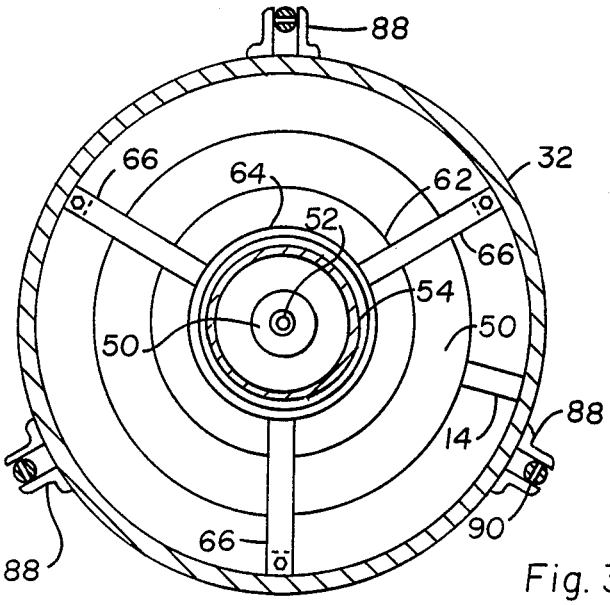
Fig. 3
Fig. 5
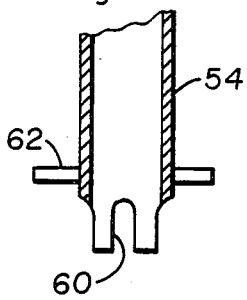

DUSTING APPARATUS

This invention concerns dusting device such as used in coal mines, and particularly concerns such a device which can more effectively provide low levels of dust, e.g., limestone dust, of uniform densities or solids concentrations to the mine ventilation air currents for transportation thereby over substantial distances.

In underground coal mines, large amounts of coal dust are necessarily generated by the cutting, blasting, loading, crushing and the like of the coal. This dust not only is present in high concentrations at these sites but is carried by the mine ventilation air currents from these sites, as well as from belt conveyor transfer points and locations along the belt conveyor where ventilation checks are installed, throughout the mines until it settles out on down stream surfaces. Such atmospheric dust, and settled-out dust accumulations are fire and explosion hazards and must be periodically cleaned up or made inert by the addition of limestone rock dust.

The present invention concerns a machine which is employed to spary or discharge limestone rock dust into the ventilation air currents of mines, particularly at locations along the belt conveyor which have become covered with coal dust, and is defined as an apparatus for dispersing dust material into the atmosphere at low concentration levels and substantially uniform rates, comprising tank means, fluidizer means positioned in a lower portion thereof, air feed means communicating with said fluidizer means, discharge port means in an upper portion of said tank means, tubular densifier means mounted substantially vertically in said tank means and extending from a lower portion thereof to adjacent said port means, said densifier means having air inlet means adjacent its lower end and outlet means adjacent its upper end in direct and immediate communication with said port means, air feed means communicating with said air inlet means, said densifier means having longitudinally spaced passage means through its wall providing for the transfer of dust material from said tank means into said densifier means for transportation to said port means.

This machine is conveniently powered, for example, by the moving conveyor belt through a traction roller which is placed in frictional contact with the conveyor belt and is rotated thereby. A blower is driven by the turning traction roller by means of sheaves and V-belts in known manner, and forces air through the tank of the dusting apparatus which is filled with finely comminuted limestone rock particles. The outlet port at the top of the tank allows the air to escape, carrying the limestone rock dust with it at a slow, even rate and allows only the finely comminuted solids to emit into the ventilation air current.

The invention will be further understood from the following description and drawings wherein:

FIG. 2 is a cross-sectional view taken along line 2—2 of FIG. 1 in the direction of the arrows;

FIG. 3 is a cross-sectional view taken along line 3—3 of FIG. 1 in the direction of the arrows;

FIG. 4 is a partial cross-sectional view taken along line 4—4 of FIG. 1 in the direction of the arrows; and FIG. 5 is a cross-sectional view of the lower portion of the densifier.

Figure 1:
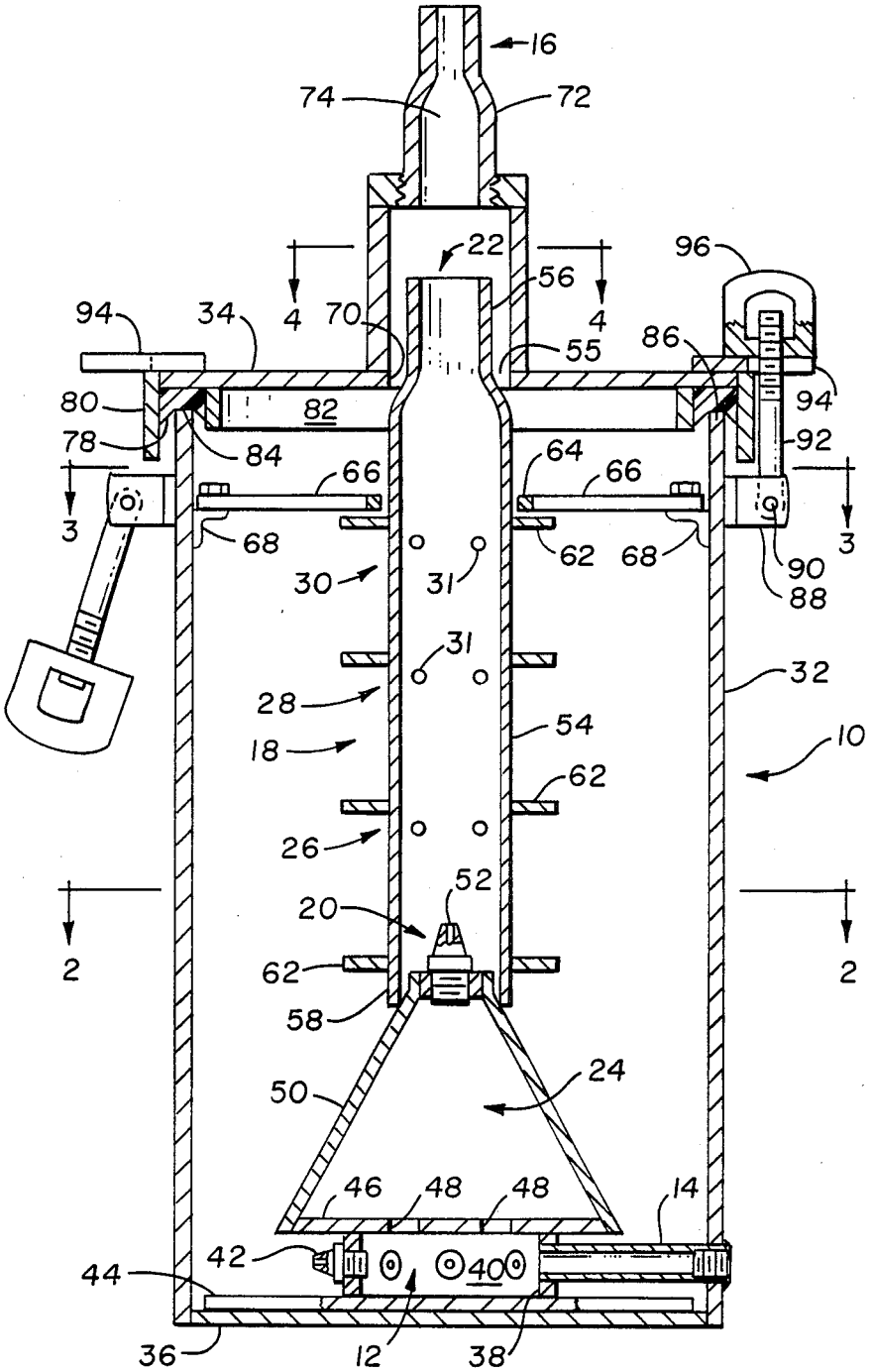
FIG. 1 is a cross-sectional view of the dusting apparatus in upright, operable position.

Referring to the drawings wherein certain dimensions are exaggerated for purposes of clarity and wherein the drawings are not to scale, and with particular reference to the above definition of the present invention, the apparatus for dispersing dust material into the atmosphere at low concentration levels and substantially uniform rates, comprises tank means 10, fluidizer means 12 positioned in a lower portion thereof, air feed means 14 communicating with said fluidizer means, discharge port means 16 in an upper portion of said tank means, tubular densifier means 18 mounted substantially vertically in said tank means and extending from a lower portion thereof to adjacent said port means, said densifier means having air inlet means 20 adjacent its lower end and outlet means 22 adjacent its upper end in direct and immediate communication with said port means, air feed means 24 communicating with said air inlet means, said densifier means having longitudinally spaced passage means 26, 28, 30, each comprising a plurality of apertures 31 through the wall thereof providing for the transfer of dust material from said tank means into said densifier for transportation to said discharge port means.

In greater detail, tank 10 may be of any shape or configuration and of any material including steel, plastic, fiber glass and ceramic, however, for ease of construction and efficiency of operation a cylindrical construction as shown comprising wall 32, top or lid 34, and floor or bottom 36, and of steel, are preferred. In the drawings, the thicknesses and other dimensions, as well as scale of the various parts are typically exaggerated for clarity, but are more accurately defined where important to the invention.

Positioned in the tank at or near the bottom thereof is an air fed fluidizer comprising a wall or shell 38 of any configuration for providing a plenum 40, but preferably circular, having a plurality of air jets 42 circumferentially spaced therearound, preferably substantially uniformly. Air feed line 14 opens directly into the plenum and is adapted at its outer end to connect, in any known manner, to an air pressure source. In the embodiment shown, the cylindrical wall 38 is welded to a separate plate 44 to provide its floor, however, where removability, e.g., for maintenance of the fluidizer is not a factor, the wall can be welded directly to the tank bottom 36 during fabrication of the tank. It is noted that plate 44 is provided with portions which are radially dimensioned with respect to the tank diameter such that it can maintain the fluidizer in a substantially centralized radial position within the tank for maximizing the fluidization efficiency. The jets 42 should be so constructed, and of course the air pressure in the plenum so regulated as to deliver a stream of air which would have a comminuting affect on agglomerates of the solid (e.g. limestone) material, such as where the agglomerates contain sufficient moisture to stick the material together.

The top 46 of the plenum conveniently provides also the floor of air feed means or chamber 24 and is provided with one or more apertures or passages 48 formed therein. A wall 50, preferably of conical shape is secured by welding or the like to 46 at its periphery and is provided at its apex with an orifice or jet 52.

The densifier 18 is conveniently in the form of a steel tube 54 having a reduced upper end 56 which may be in the form of a reduction fitting secured to the top of the tube. The lower end 58 of the tube which provides the inlet generally shown as 20, is positioned, in the particular embodiment of the drawings, over jet 52 and rests on the conical wall 50. The lower edge of the tube is provided with several slots 60, preferably four, to allow any heavy particulate materials which, e.g., are dumped into the tube during the filling operation, to exit into the fluidization area.

It is noted that as an alternative to the air feed means 24 and 48 as shown and as described above, a separate line such as 14 could be directly connected either to 24 or to jet 52 to provide an independent air source for transporting dust material upwardly in the densifier. Such a structure is particularly advantageous from the standpoint of allowing for separate airflow control valves on the feed line to the fluidizer and densifier to provide fine-tune adjustments of air flows for insuring on the one hand adequate agitation and comminution in the fluidizing area and on the other hand the proper degree of lift and solids transportation upwardly in the densifier to the discharge port. Should such alternative structure be employed, there would need to be no direct connection or juxtaposition of the bottom of the densifier and the top of the plenum.

As aforesaid, passage means 26, 28, 30 are provided in the tube wall, and each series or level thereof, comprises, e.g., about 4–8 passages substantially equally spaced around the tube through the wall thereof. Preferably, there are secured to the tube immediately above these passages, shields such as 62 which prevent excessively heavy dust settling and accumulation at the passages and possible clogging thereof. These shields may have other configurations such as square, or individual or separate for each passage, and may be, e.g., arched or cone shaped such that heavier dust particles settling out will tend to fall off the shields at a substantial radial distance from the tube and reenter the fluidization area, thereby not tending to collect on top of the shields. This particular arrangement of passages 26, 28, 30 is preferred but is not critical to the present invention. Other arrangements may be employed, for example a spiral or helical configuration both of the passages and the shields immediately thereabove.

It is noted that this conical configuration is employed for wall 50 and tends to direct the heavier agglomerates to the areas directly adjacent the fluidizing jets 42 for achieving maximum comminution and fluidization. The densifier is held in upright position in the tank by any suitable means such as collar 64 slidable over tube 54 or affixed thereto, and having arms 66 which are bolted or otherwise secured to brackets 68 welded or the like to the wall of the tank.

The tank top 34 is provided with opening 70 which is surrounded by dome 72 welded or otherwise affixed to the top. The dome is provided with the discharge port 16 and forms a chamber 74 into which the densifier outlet 22 emits the dust. This outlet is extended above the plane of top 34 in order that any heavy or non-comminuted dust material which may be forced up through the by-pass space 55 between the end 56 of the densifier and the edges of opening 70, particularly during the early periods of operation when the solids level is at or near or even bove the normal fill like 76, will tend to fall back into the tank rather than into the densifier tube where it might become lodged at the bottom and affect the air flow therein. It is noted that is is not critical that the densifier tube be necked down at the top 56, however, such is an expedient way to provide increased operating volume to the densifier while controlling the dust emission rate therefrom.

The tank top 34 is preferably provided with a seal such as 78, retained, e.g., between spaced rims 80 and 82. This seal may be of any sealing material including elastomer, rubber or the like and in a preferred embodiment is formed with an inverted "V" groove 84 for accurately receiving the top edge 86 of the tank and centering the opening 70 with respect to the upper end 56 of the densifier tube to thereby provide maximum uniformity to the by-pass space therebetween and the dust flow therethrough.

The top 34 and adjacent upper wall of the tank are provided with cooperating means forming a latching mechanism for allowing easy and rapid removal of the top for refilling the tank. This latching means may of course take many forms and configurations and the one shown in the drawings in operative sealing position is exemplary and comprises a plurality of brackets 88 attached to the tank wall, each carrying a pin 90 pivotally mounting a screw 92, a sloted shoulder member 94 affixed to the tank top adjacent each screw 92, and a ring nut 96 on each of said screws. The operation of this latching mechanism to remove the top is very simple and consists of loosening the nuts and pivoting the screws outwardly away from the shoulder members, however it is also very effective in providing the proper sealing force.

The basic structural components of the apparatus have been described above, however, certain details of construction are especially important as will become evident as the operation of the present apparatus is explained more fully.

In regard to the theory of operation of the densifier, it is noted that during the early period of operation after refilling, when the solids level is high, a simple top outlet for the dust would probably be passably effective since the dust density would be high adjacent thereto. However, as the solids level drops, with the internal pressure remaining substantially constant, the density of the dust within upper areas of the tank diminishes since the total solids content diminishes, and therefore, the density of the discharge dust diminishes. In the lower areas of the tank however, the dust density is higher and proper pick-up by the densifier from these areas results in increased discharge dust densities. In order for this to happen however, the inlet air flow to the densifier needs to be sufficient to carry the more dense dust material upwardly to the discharge port somewhat preferentially to the less dense dust material in the upper areas of the fluidizer. In this regard, there will always need to be a balance struck between densifier emissions back into the tank through the higher passage means, e.g., 30 and the air flow maintained in the densifier through jet 52 in order to properly maintain the density of the dust discharged at the desired levels as the total solids content of the tank gradually diminishes.

As an example of actual highly efficient apparatus specifications, the following approximate dimensions appear to represent the best mode for the present invention as it is applied to the apparatus of the drawings using steel as the construction material:

| | |
|---|---|
| Tank Diameter | 18.0 in. |
| Tank Height | 29.0 in. |
| Tank Wall Thickness | 16 gauge |
| Tank Bottom Thickness | 0.125 in. |
| Tank Top Thickness | 0.125 in. |
| Top Seal (78) width | 0.75 in. |
| Top Seal (78) Height | 0.44 in. |

-continued

| | |
|---|---|
| Densifier Length (total) | 23.75 in. |
| Densifier Outside Diameter | 1.75 in. |
| Densifier Wall Thickness | 0.12 in. |
| Cone Diameter (inside top) | 1.0 in. |
| Cone Diameter (inside bottom) | 7.0 in. |
| Cone Wall Thickness | 0.12 in. |
| Cone Floor Thickness | 0.375 in. |
| Penum Diameter (outside) | 4.5 in. |
| Fluidizer Wall Thickness | 0.375 in. |
| Pate (44) Thickness | 0.375 in. |
| By-pass (55) Gap Width | 0.125 in. – 0.5 in. |

The invention has been described in detail with particular reference to preferred embodiments thereof, but it will be understood that variations and modifications will be effected within the spirit and scope of the invention.

I claim:

1. Apparatus for dispersing dust material into the atmosphere at low concentration levels and substantially uniform rates, comprising tank means adapted for holding substantial quantities of solid, particulate dust material, fluidizer means positioned in a lower portion of said tank means, air feed means communicating with said fluidizer means, discharge port means in an upper portion of said tank means communicating with the ambient atmosphere, tubular densifier means mounted substantially vertically in said tank means and extending from a lower portion thereof to adjacent said discharge port means, said densifier means having air inlet means adjacent its lower end and outlet means adjacent its upper end in direct and immediate communication with said discharge port means, air feed means communicating with said inlet means, said densifier means having a series of longitudinally spaced apertures in the wall thereof providing for the substantially non-pressurized transfer of solid dust material from said tank means into said densifier means for transportion to said discharge port means and into the ambient atmosphere.

2. The apparatus of claim 1 wherein said fluidizer means comprises plenum means having a plurality of jets therein spaced circumferentially thereround and directed generally radially outwardly therefrom.

3. The apparatus of claim 1 wherein shield means is provided on the exterior surface of said densifier means adjacent to and overlying said passage means for preventing excessive solids build-up therearound.

4. The apparatus of claim 1 wherein said fluidizer means and densifier means are substantially radially, centrally positioned in said tank means.

5. The apparatus of claim 1 wherein said tank means is comprised of a generally cylindrically shaped wall, a top and a floor.

6. The apparatus of claim 5 wherein said fluidizer means is positioned substantially centrally of and adjacent said floor.

7. The apparatus of claim 6 wherein said fluidizer means comprises plenum means having a plurality of jets therein spaced circumferentially therearound and directed generally radially outwardly therefrom.

8. The apparatus of claim 1 wherein said fluidizer means comprises generally cylindrical wall means, a substantially flat top and a substantially flat bottom, providing a plenum chamber, a plurality of jets in said wall means spaced circumferentially therearound, generally conical wall means having its base secured to said top, orifice means in the apex of said conical wall means, said densifier means being positioned directly above and substantially axially aligned with said conical wall means with the lower end of said densifier means contacting said conical wall means adjacent the apex thereof to directly communicate said orifice means with the inlet means of said densifier means, and aperture means in the top of said plenum for providing air to said densifier means through said office means.

9. The apparatus of claim 8 wherein said tank means is comprised of a top, a bottom, and side wall means, said top having an opening therein, said discharge port means comprising a generally cylindrical dome having an outlet and being secured at its base to said top of the tank means with said base surrounding said opening therein, the upper end of said densifier means projecting through said opening and extending partially into said dome, said upper end of said densifier means being slightly spaced from the edges of said opening to provide a dust material by-pass to said outlet of said dome.

10. The apparatus of claim 9 wherein said top and upper portions of said side wall means of said tank means are provided with cooperating latch means for removably retaining said top on said tank means.

11. The apparatus of claim 10 wherein cooperating alignment means is provided on said top and side wall means of said tank means for insuring substantial centering of said upper end of said densifier within said opening in said top.

12. The apparatus of claim 1 wherein said series of spaced apertures is provided in said densifier means according to the ratio, distance between passage means/diameter of densifier means, and ranges from about 2 to about 5.

13. The apparatus of claim 1 and wherein slot means is provided in the lower edge of said densifier means for providing egress for heavy particulate material settled in said densifier means.

* * * * *